United States Patent [19]

Burge

[11] Patent Number: 4,467,879

[45] Date of Patent: Aug. 28, 1984

[54] WELL BORE TOOLS

[75] Inventor: Edward V. Burge, Houston, Tex.

[73] Assignee: Richard D. Hawn, Jr., Dallas, Tex.

[21] Appl. No.: 362,741

[22] Filed: Mar. 29, 1982

[51] Int. Cl.[3] ..... E21B 17/10; E21C 9/00

[52] U.S. Cl. ..... 175/325; 308/4 A

[58] Field of Search ..... 175/325, 323, 324, 320, 175/326, 76, 408, 406, 407, 329, 330; 166/173, 241; 308/4 A

[56] References Cited

U.S. PATENT DOCUMENTS

| | | | |
|---|---|---|---|
| 1,153,811 | 9/1915 | Montgomery | 175/394 |
| 2,247,564 | 7/1941 | Turner | 308/4 A |
| 2,373,880 | 4/1945 | Driscoll | 166/241 |
| 2,714,500 | 8/1955 | Snyder | 175/323 |
| 2,722,462 | 11/1955 | Tschirley | 308/4 A |
| 2,869,827 | 1/1959 | Cook | 175/325 |
| 2,956,781 | 10/1960 | Eastman | 175/325 |
| 3,011,556 | 12/1961 | Best | 166/173 |
| 3,054,647 | 9/1962 | Von Rosenberg | 308/4 A |
| 3,180,436 | 4/1965 | Kellner et al. | 175/325 |
| 3,268,274 | 8/1966 | Ortloff et al. | 308/4 A |
| 3,318,398 | 5/1967 | Owen | 175/323 |
| 3,833,077 | 2/1974 | Lavallee | 175/329 |
| 3,938,853 | 2/1976 | Jürgens et al. | 166/241 |
| 4,156,374 | 5/1979 | Shwader | 175/325 |
| 4,280,742 | 7/1981 | Justman | 175/325 |

*Primary Examiner*—Ernest R. Purser
*Assistant Examiner*—Hoang C. Dang
*Attorney, Agent, or Firm*—Joseph H. Schley; Thomas L. Cantrell; Stanley R. Moore

[57] ABSTRACT

Well bore tools configured as centralizers/stabilizers, well bore reamers, and keyseat wipers each of which includes an elongate tubular body having a generally cylindrical outer surface and a diameter approximately equal to the diameter of the borehole being drilled. Each tool affords an improved mode of drilling a borehole by increasing downhole directional control and stability, increasing tool wear reliability, and reducing return mud flow resistance. The outer surface of each tool has a plurality of longitudinal passages formed in pairs of upright intersecting right and left hand helicies or spirals about the exterior of said tool and extending from one end to the other end thereof. The intersecting right and left hand helical or spiral channels form raised pad areas therebetween to provide 360° contiguous well bore contact by each tool for enhanced stability and efficiency. In addition, the intersecting right and left hand helical channels afford greater surficial engagement area while providing unobstructed return mud flow paths between each tool and the wall of the borehole. The raised pad areas may have wear resistant surfaces which are arranged in a configuration for affording constant 360° contiguous contact with the wall of the borehole. Preferably, the wear resistance surfaces are provided by replaceable inserts mounted in recesses in the pad areas.

16 Claims, 8 Drawing Figures

WELL BORE TOOLS

BACKGROUND OF THE INVENTION

1. The Field of the Invention

The invention relates to well bore tools and, more particularly, to well bore tools having improved outer surface configurations and performance characteristics for improved efficiency in borehole drilling.

2. History of the Prior Art

Borehole wall engaging tools, such as stabilizers, reamers and keyseat wipers, are frequently used in sections of the pipe or drill string of oil and gas well drilling rigs. Stabilizers are essentially enlarged sections of the drill string which provide limited surface area radially outwardly of the drill pipe and which tend to center said drill string and the drill bit within the borehole. Reamers also serve to center the drill bit within the borehole and, additionally, to cut and shape the wall of said borehole behind said bit. Keyseat wipers are used to smooth out the borehole wall by removing small heterogenities and other deviations from said borehole wall as the drill bit continues to move downwardly through varying earth formations.

More specifically, drill bits for drilling through earth and rock are generally designed to rotate about their own centers. Stabilizing the drill bit centrally within the borehole ensures the maximum specified drill penetration rate and maximum downhole control. Uncontrolled or unstabilized drill pipe lengths or sections of the drill string manifest a "flopping" action within the borehole and become subject to torsional vibrations during operation. These conditions contribute to power loss as well as equipment breakdown due to frictional wall engagement from the drill string which decreases the life of the pipe lengths and the tool joints therebetween.

In order to maintain the needed downhole concentricity, the drill bit is preferably followed closely by a reamer to centrally hold said bit within the borehole. The drill string generally includes periodically spaced stabilizers to hold its upper and intermediate sections concentric within the borehole. Without stabilization, the drill pipe tends to move out of concentricity producing undesirable chatter and deleterious wear. The drill string may also bump along the borehole wall thereby increasing power loss and wear on said drill string.

In the event that borehole wall deviations do occur, such as keyseats, it is preferable that they be removed and smoothed over as early as possible to prevent the hanging up of any portion of the drill string during subsequent insertion and/or removal from the borehole. A keyseat wiper in a borehole wall engaging tool having a slight downward taper which functions upon rotation of said tool as well as axial movement to smooth away pits or other deviations in the borehole wall.

The prior art has addressed the design of such borehole wall engaging tools by providing downhole tools with either radially outwardly extending ribs or individual spaced apart protrusions which selectively engage said borehole wall. Ribbed stabilizers are of generally two types, having either longitudinally extending plates or ribs spiraled about the exterior or outer surface of a stabilizer. Initially, rib-type stabilizers are made to conform to the radius of the drill bit and their external surfaces engage and rub against the borehole wall in order to maintain concentricity of the drill string with said borehole. This is also generally true of other prior art borehole wall engaging tools, such as reamers and wipers.

The outer exposed surfaces of these stabilizers and reamers are designed to scrape and rub against the borehole wall during downhole operation. Because the borehole generally extends through a multitude of various earth and rock formations, there is considerable abrasion between the tool and borehole which quickly wears the outer surfaces of such ribs or plate elements. This abrasion quickly ruins the accuracy of the radial dimensions of the outer surfaces of the tool. It may also be seen that the borehole wall engaging tools, which have longitudinally and circumferentially spaced discrete protrusions of the prior art variety, are then subject to the type of wear which results in a lack of concentricity within the borehole. This, in turn, results in a lack of longitudinal-transverse stability (i.e. directional control) of the tool within the borehole and a myriad of related operational problems.

THE PRESENT INVENTION

The borehole tools of the present invention solve many of the problems inherent in the use of such prior art tools having either spaced apart ribs, plates, or discrete protrusions to engage the borehole wall. These tools advantageously maximize the surficial contact area of the borehole wall engagement while minimizing drilling fluid or mud flow restrictions and deterioration of the outer surface of said tools due to abrasive wear. The tools of the present invention provide a more positive three hundred and sixty degrees (360°) contiguous contact with the well bore wall along the entire length of said tools. The continuous contact with the borehole wall provided by these tools decreases the possibility of keyseats, doglegs or other borehole deviations. This is accomplished while increasing the directional control and stability of the drill string for smoother, straighter borehole configurations. In addition, the continuous borehole wall engagement of this invention inhibits torsional vibrations and "flopping" action of the drill string so as to increase the life of said drill string and the tool joints thereof. It may also be seen that power loss in the drilling rig due to frictional wall drag of the drill string in the borehole will be reduced.

Finally, one of the key problems inherent in simply increasing the area of contact of a borehole wall engaging tool is the resultant resistance to drilling fluid or mud flow in the annular space between the drill string and the borehole wall. The tools of this invention use a system of intersecting right and left hand helical channels or grooves and provide improved outer surfacial contact of pad areas from end to end of said tools. This system of channels minimizes the obstruction to drilling fluid or mud flow upwardly through the annular passage between the drill string and borehole wall. Typically, there may be two pairs of right and left hand intersecting helical channels or a total of four channels.

SUMMARY OF THE INVENTION

The present invention relates to an apparatus for borehole drilling wherein well bore tools are configured with a plurality of intersecting right and left hand helicies or spirals about the tool periphery or cylindrical exterior. More particularly, in one aspect, the invention comprises a borehole wall engaging tool for coupling in a drill string, wherein the tool has an enhanced surface area for maximizing peripheral surface engagement with the wall of the borehole during rotation. The tool comprises an elongate generally cylindrical body having an axial bore with tool joints at opposite ends of the body for coupling or connection in the drill string. A plurality of pad areas are formed on the outer surface or periphery of the tool and are defined by a pair or plurality of upright intersecting right and left hand helical channels or grooves formed in said periphery. These channels facilitate the flow of drilling fluid upwardly through the borehole so as to minimize resistance thereto. The helical channels are generally rectangular in cross-sectional configuration and form staggered patterns of pad areas therebetween. In this manner, the borehole wall is continuously engaged by overlapping surficial contact areas of the tool during rotation and in a manner facilitating the flow of drilling fluid or mud. Preferably, a multiplicity of wear resistant inserts are mounted in recesses formed in the raised pad areas of the tool for engaging the borehole wall and maximizing the durability and effectiveness of said tool.

In yet another aspect, the invention includes an improved borehole wall engaging tool utilized in the presence of mud or drilling fluid flow for rotational engagement with said borehole wall. The tool includes a generally cylindrical, elongate body having an axial coextensive bore and communicating tool joints at opposite ends for coupling in a drill string. The improvement comprises a plurality of pad areas on the outer periphery or exterior of the body and a multiplicity of wear-resistant surfaces on the pad areas. A plurality of intersecting right and left hand helical channels are provided in the exterior of the body and define the pad areas therebetween with overlapping surface areas. The tool is positioned in a drill string, and the string within a borehole for drilling. Drilling fluid or mud is pumped downwardly within the drill string and drill bit into the borehole and is forced to flow upwardly around the drill string, said fluid passing upwardly through the helical channels and around the pad areas.

BRIEF DESCRIPTION OF THE DRAWINGS

For a more complete understanding of the present invention and for further objects and advantages thereof, reference may now be had to the following decription taken in conjunction with the accompanying drawings, in which.

DESCRIPTION OF THE PREFERRED EMBODIMENT

Figure 1:
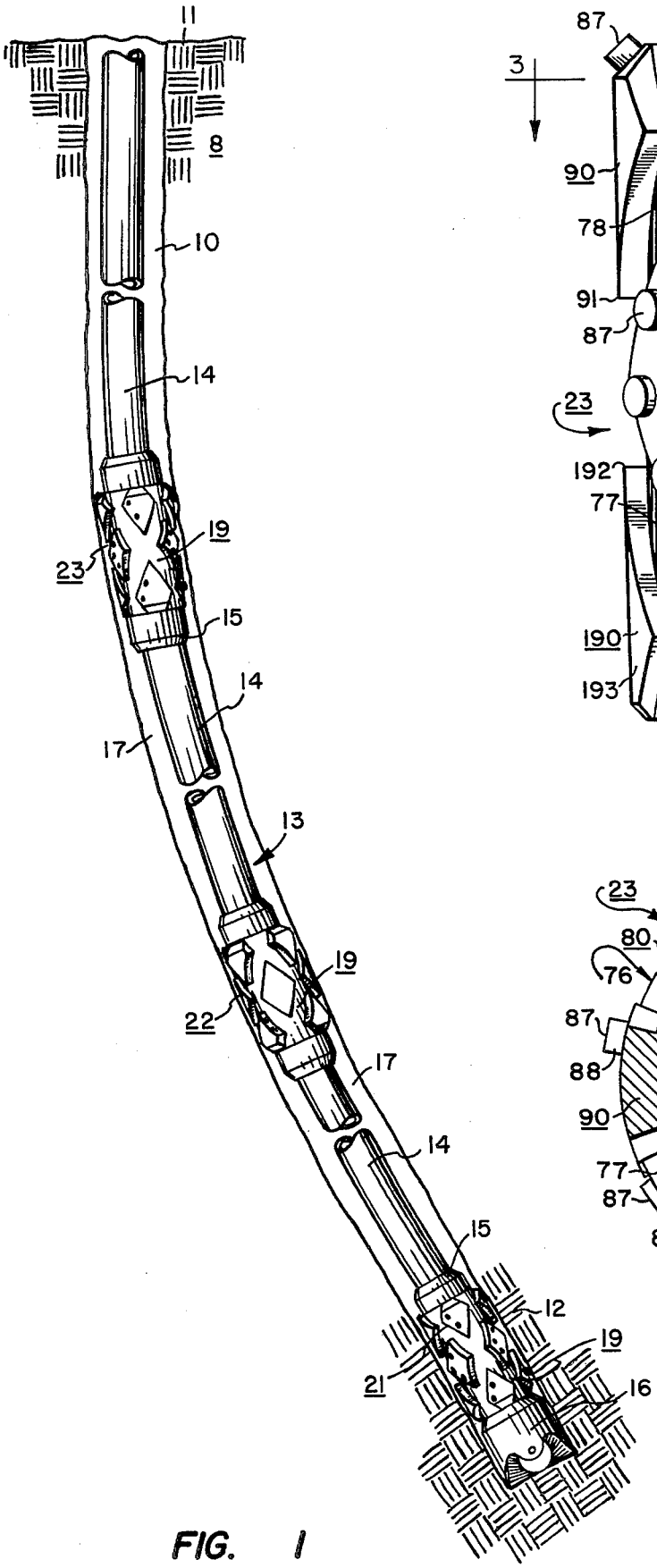
FIG. 1 is a fragmentary side elevational view of a drill string having three different types of borehole wall engaging tools constructed in accordance with the principles of the present invention and positioned within a borehole.

Referring to FIG. 1, a well borehole 10 is shown formed within earth 8 and extending from the surface 11 through subterranean formation 12. Positioned within borehole 10 is a drill string 13 comprised generally of lengths or sections of drill pipe 14, each length having a mating coupling 15 at each end. Drill string 13 has a conventional drill bit 16 mounted on its lower end for penetrating earth formation 12 and forming the borehole. Drilling fluid or mud is adapted to be pumped downwardly through the drill string and outwardly through openings in drill bit 16, and then, is forced back up borehole 10 to the surface 11 through annular space 17 formed between the exterior of said drill string and the borehole wall.

Figure 3:
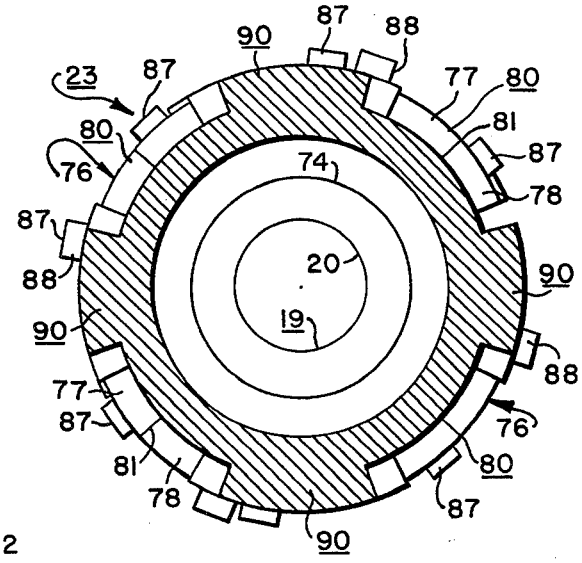
FIG. 3 is a horizontal cross-sectional view of the keyseat wiper tool of FIG. 2 taken on the lines 3—3 thereof.

As shown in FIG. 1, three separate borehole tools of the present invention are shown coupled to and extending longitudinally of drill string 13. A reaming tool or reamer 21 of the present invention may be mounted in the lower end of the drill string above drill bit 16. One or more stabilizing/centralizing tools or stabilizer/centralizer 22 may be connected in drill string 13 above reamer 21, only one being illustrated. Above stabilizer 22, a keyseat wiper or wiping tool 23 may be coupled in the drill string. Preferably, each of the tools 21, 22 and 23 includes an elongate cylyndrical body 19 having an axial coextensive bore 20 (FIGS. 3,6,7) internally screwthreaded at its ends to provide box joints for engagement by externally screwthreaded tool joints of the pin type at the ends of pipe lengths or sections 14 of the drill string therebetween. The basic functions of the aforesaid tools are convventional in nature. For example, reamers generally function to hold a drill bit concentrically within the borehole as well as to enlarge the wall of said borehole and smooth said borehole wall for the passage of subsequent drill pipe lengths or sections therethrough. Reamer or reaming tool 21 of the present invention improves the stability, reliability and control of this function. Stabilizer or stabilizing tool 22 similarly holds the drill string concentrically within borehole 10, while keyseat wiper or wiping tool 23 smooths the wall of said borehole and removes any deviations and other borehole wall defects left by the reamer or reaming tool. The structure of the apparatus of the present invention greatly improves the effectiveness of these operations.

Figure 4:
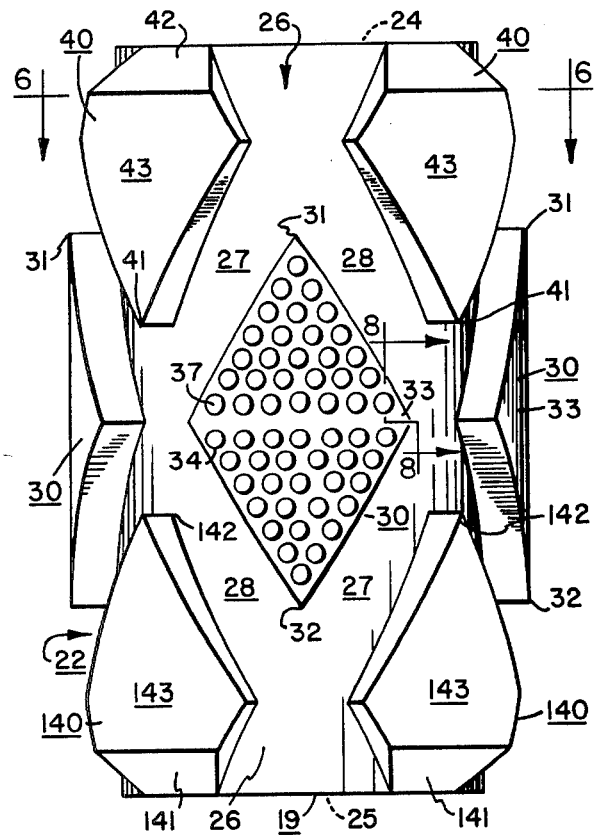
FIG. 4 is an enlarged side elevational view of a stabilizer/centralizer tool constructed in accordance with the invention and illustrated as the intermediate tool in FIG. 1.
Figure 6:
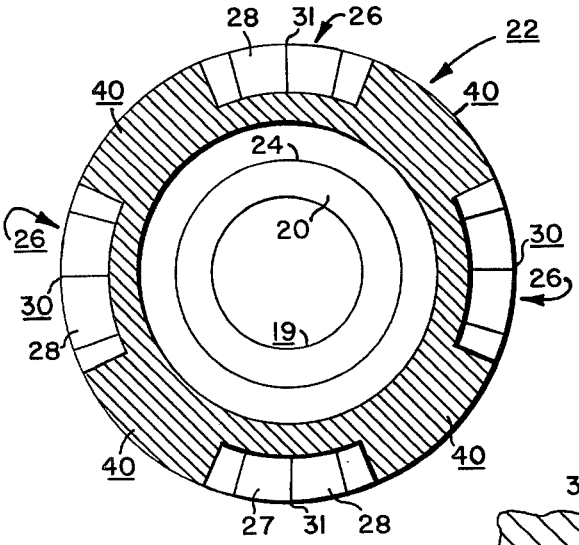
FIG. 6 is a horizontal cross-sectional view of the stabilizer/centralizer of FIG. 4 taken on the lines 6—6 thereof.

Referring next to FIGS. 4 and 6, body 19 of centralizer/stabilizer or centralizing/stabilizing tool 22, constructed in accordance with the present invention, is generally cylindrical and has box joints 24 and 25 at the ends of its axial bore 20. The generally cylindrical exterior or peripheral surface of the stabilizer has formed therein a plurality of longitudinal flow channels or passages 26 of generally rectangular cross section. Longitudinal flow channels 26 are disposed in two coacting pairs of right and left hand upright intersecting helicies or helical spirals with one channel 27 of each pair spiraling upwardly in the right hand direction and the other channel 28 spiraling upwardly in the opposite or left hand direction. Right and left hand channels 27, 28 of each pair intersect only at their medial portions, the upper and lower end portions of said channels 27, 28 of each pair intersecting the upper and lower end portions of channels 28, 27, respectively, of the other pair as clearly shown in FIG. 4. The respective helical channels of the embodiment shown herein are formed with an angle of approximately thirty degrees (30°) between their axial centers, and this angle may be varied for various tool applications and, particularly in accordance with downhole conditions.

A plurality of pads or pad-like areas 30, 40 and 140 are formed between channels 26 of stabilizer 22 and together comprises a segmented, cylindrical exterior or outer periphery of sufficient diameter to provide continuous engagement with the wall of borehole 10 as well as enhanced surficial area for continuous contact with said borehole wall. Pads 30 are diamond-shaped, elongated vertically and disposed in a horizontal row or ring in equally spaced relationship around the intermediate or medial portion of the stabilizer outer periphery. The other pads or pad-like areas 40 and 140 are of somewhat similar shape and horizontal spacing, being disposed about the upper and lower end portions, respectively, of the periphery of stabilizer 22 in similar horizontal rings or rows vertically spaced above and below medial pads 30. These upper and lower pads are vertically aligned and offset or staggered relative to the intermediate or medial pads so as to be disposed therebetween. The upper and lower end portions 31, 32 of pads 30 overlap the complementary lower or inner end portions 41 of upper pads 40 and the upper or inner end portions 142 of lower pads 140, respectively. As shown by numerals 42 and 141, the outer or upper end portions of the upper pads and the outer or lower end portions of the lower pads are truncated and terminate in flat ends in horizontal alignment with the ends of the stabilizer. Preferably, upper and lower or outer end portions 42, 141 of upper and lower or outer pads 40, 140 are bevelled or inclined inwardly toward the exterior of body 19 so as to facilitate vertical movement of the stabilizer/centralizer relative to the borehole as well as the flow of the drilling fluid or mud upwardly through the channels 26 past said outer or upper and lower pads. Due to these configurations, pads 40, 140 are pentagonal instead of quadrangular. Otherwise all of the pads, in particular their intermediate and lower portions, are identical. Since there are only three (3) rings or rows of pads, no pads are disposed between the outer or upper and lower portions of pads 40, 140 whereby the outer end portions of right and left hand channels 27, 28 are flared and are of greater or amplified width. Manifestly, the latter facilitate flow into and out of the channels.

When the stabilizer/centralizer or centralizing/stabilizing tool is rotated within the borehole, there is virtually constant three hundred and sixty degree (360°) contact by longitudinally and laterally spaced pads with the wall of said borehole. In addition, the pointed ends 31, 32 of medial pads 30 facilitate smooth movement and division of the drilling fluid or mud flow through channels 26 to maintain as uniform a flow as possible and to minimize obstruction due to the presence of the stabilizer, particularly, said wall-engaging pads within the borehole.

Figure 8:
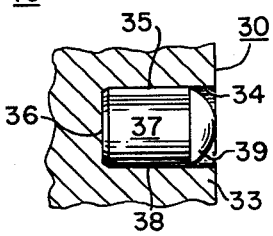
FIG. 8 is an enlarged, fragmentary, cross-sectional view taken on the lines 8—8 of FIG. 4 and showing a wear resistant insert in the outer surface of the stabilizer tool.

In FIG. 4, the exterior or outer surface 33 of one of pads 30 may be typical of all the pads 30, 40, 140 of stabilizer 22 and have a multiplicity of radial openings or recesses 34 formed therein. For clarity, no recesses are shown on the remaining pads of the stabilizer. As shown in FIG. 8, each recess 34 has a cylindrical wall 35 terminating at an upright bottom 36. A complementary replaceable wear resistant insert 37 is mounted within each recess and has a cylindrical body 38 seating against recess bottom 36. Each insert 37 may have a hemispherical top or outer end 39, preferably, and this top is coated with an industrial diamond impregnated material to enhance its wear resistance. Body 38 of the insert is preferably formed of a material such as tungsten carbide for durability. More specifically, inserts of this general type and other configurations, are available through the General Electric Company as speciality materials and may be designated by the trademark STRATAPAX. It should be apparent that any number of insert shapes and sizes and constructions may be used within the spirit and scope of the present invention.

Stabilizer 22 of FIG. 4 is thus capable of utilizing select inserts for operating extended periods of time within borehole 10. The outer surface of the stabilizer constantly abrades the borehole wall during operation and by incorporating the inserts as shown herein, its durability is greatly increased. This enhanced surface area permits stabilizer 22 to more uniformly engage the wall of the borehole throughout the entire length of said tool. Thus, the stabilizer inhibits the "flopping" of drill string 13 within the borehole and increases the life of the tool joints and the drill string sections or lengths themselves.

In effect, channels 26 are defined by and disposed between adjacent diamond shaped medial pads 30 (FIG. 6) as well as by and between adjacent outer and upper and lower pads pentagonal 40, 140. The outer ends or tops 39 periphery of inserts 37 need not protrude from the medial pads in this particular embodiment wherein the exteriors of said pads comprise a substantially continous borehole wall engaging surface around stabilizer or stabilizing tool 22. This configuration permits the requisite flow of the drilling fluid or mud through channels or passages 26 in accordance with the teachings of the present invention.

Figure 5:
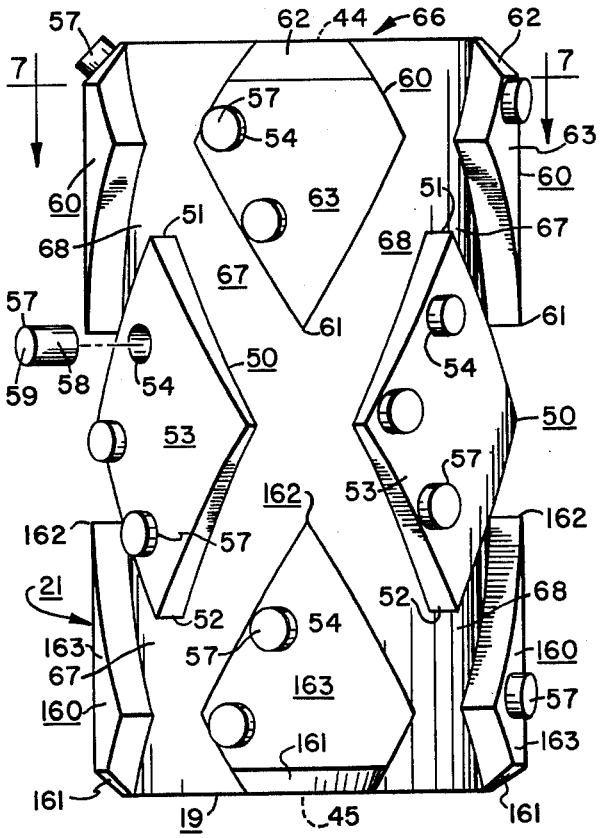
FIG. 5 is an enlarged side elevational view of a reamer tool constructed in accordance with the invention and illustrated as the lowermost tool in FIG. 1.
Figure 7:
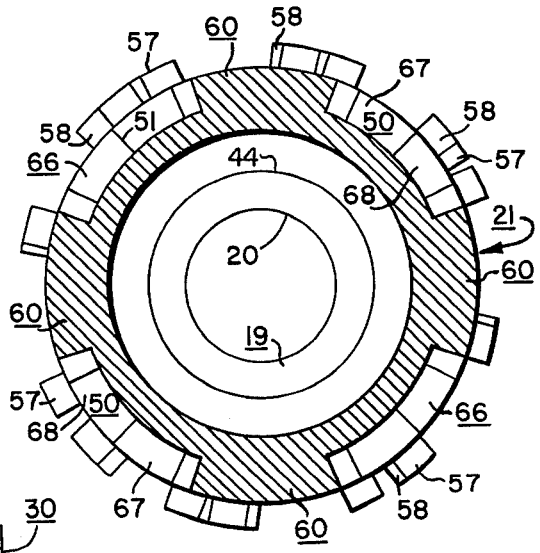
FIG. 7 is a top plan, cross-sectional view of the reamer tool of FIG. 5 taken on the lines 7—7 thereof.

Referring now to FIGS. 5 and 7, reaming tool or reamer 21 of FIG. 1 is shown constructed in accordance with the principles of the invention and has internally screwthreaded or box-joints 44, 45 in its ends for coupling in drill string 13. The reamer also includes a plurality of longitudinal intersecting right and left hand helical channels or grooves 66 formed its exterior outer surface, and a plurality of diamond-shaped pads or pad-like areas 50, 60, 160 are defined by and disposed between the helical channels. The medial pads 50 and channels 66 are similar to medial pads 30 and channels 26 of FIG. 4; and said pads 50, 60, 160 are arranged in circular rows or rings surrounding the intermediate or medial portion, the upper and lower or outer portions, respectively, of the reamer. Each channel 66 is generally rectangular in cross-section, being formed at a selected angle, an angle of thirty degrees (30°) being shown herein for purposes of illustration. These channels permit the maximum amount of drilling fluid or mud flow from drill bit 16 back up borehole 10 while minimizing resistance due to the presence of reamer 21 within said borehole. Similarly, diamond-shaped medial pads 50 are elongated vertically and their upper and lower triangular end portions 51, 52 serve to divide the intersecting channels so as to facilitate the flow of mud as it passes the reamer.

As shown in FIG. 5, each of the medial pads 50 has a plurality of recesses 54 in its exterior or outer surface 53 adapted to receive removable inserts 57 that have cylindrical bodies 58 and enhanced wear-resistant flat outer end surfaces 59 somewhat similar to the outer ends 39 of inserts 37 (FIGS. 4, 8). Inserts 57 may be larger and fewer in number as compared to inserts 37 and are designed to project beyond the exteriors 53 of pads 50 so as to engage the borehole wall directly. Reamer 21 may thus be seen to be designed for a more aggressive cutting of the borehole wall and the forming of a cylindrical borehole immediately above drill bit 16. For this reason, each insert 57 may comprise a removable, wear-resistant cutting element protruding outwardly from the outer face 53 of pad 50.

In some instances, each insert may include a more angulated cutting surface, and said insert may be positioned in recess 54 of the medial pad at an appropriate angle to provide aggressive cutting engagement with the wall of borehole 10. Such cutting has been shown to shape the borehole wall and prevent the formation of keyseats and other deviations. The longitudinally overlapping of adjacent diamond-shaped pads and the inserts secured therein provide engagement of substantially continuous longitudinal sections of the adjacent borehole wall by the reamer during rotation thereof. This produces enhanced stability and concentricity of drill string 13 within borehole 10 and affords minimum resistance to mud flow.

Axial bore 20 of the reamer or reaming tool is coextensive with body 19 of said reamer and communicates with box joints 44, 45 at its ends. The end portions of inserts 57 protrude from the pads so as to comprise a substantially continuous borehole wall engaging surface of the reamer with drill bit 16 and the drill string during rotation, while providing requisite mud flow area through the channels. It is noted that fewer inserts 57 are utilized on pads 50 than inserts 37 on pads 30 of stablizer/centralizer 22 whereby the exterior of the reamer 21 does not appear to be circumferentially surrounded by said inserts 57 from the axial view point of FIG. 7. In this configuration, however, axial movement as well as rotation of the reamer or reaming tool effectively engages all of the associated wall of borehole 10.

Upper and lower or outer pads 60, 161 may be somewhat similar to intermediate or medial pads 50 as well as substantially identical to corresponding outer pads 40, 140 of the stabilizer/centralizer elongated lower and upper end portions 61, 162, respectively, in vertical alignment with one another. These aligned pads have outer surfaces or exteriors 63, 163 similar to surfaces 33 of pads 30 and are offset or staggered relative to the medial pads so as to be positioned therebetween. The upper end or upper portions of upper pads 60 and the outer end or lower portions of lower pads 160 are truncated and terminate in flat end surfaces 62, 161 in horizontal alignment with the ends of reamer 21. Preferably, flat end surfaces 62, 161 are bevelled and inserts 57 may be mounted on or more of said end surfaces.

Figure 2:
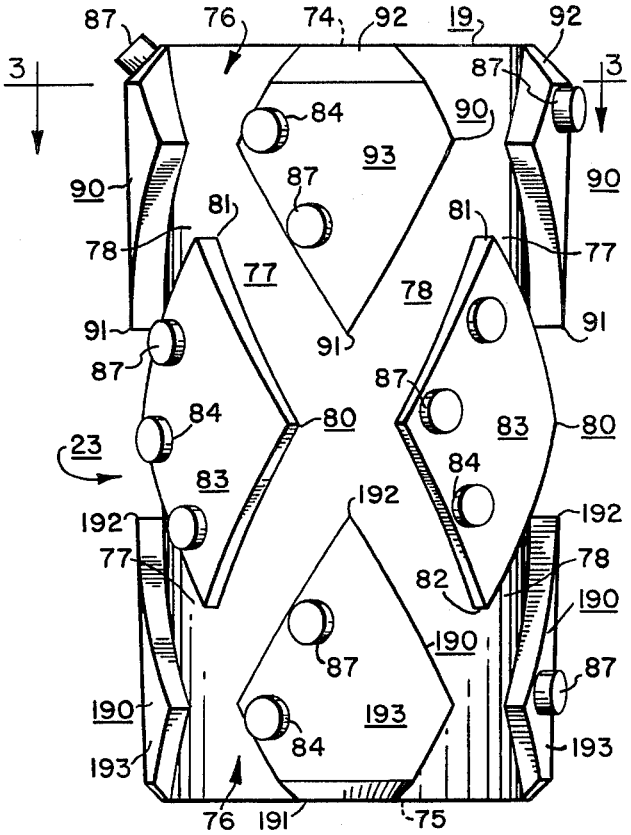
FIG. 2 is an enlarged side elevational view of a keyseat wiper tool constructed in accordance with the invention and illustrated as the upper tool in FIG. 1.

As shown in FIG. 2, keyseat wiper or wiping tool 23, constructed in accordance with the principles of the invention, has internally screwthreaded or box-type tool joints 74, 75 at the upper and lower or outer ends of the bore 20 of its body 19 for engagement with adjacent pipe or sections 14 of drill string 13. The generally cylindrical segmented exterior or outer surface of keyseat wiper 23 is selectively tapered at a slight angle from the vertical extending from its top to its bottom. This provides an inclined working surface for axial reciprocation of the keyseat wiper tool within borehole 10 to remove keyseat areas from the wall of said borehole as well as any other deviations which may occur during routine drilling operation.

Keyseat wiper 23 has a plurality of generally rectangular cross-sectional channels 76 formed in intersecting pairs of helices 77, 78 which define upright generally diamond-shaped pads or pad-like areas 80, 90, 190 therebetween. Pads 80 are disposed in a circular row or ring encircling the intermediate or medial portion of the keyseat wiper and have elongated triangular upper and lower end portions 81, 82, respectively, longitudinally overlapping similar elongated triangular lower or inner end portions 91 of upper pads 90 and similar upper or inner end portions 192 of lower pads 190. This overlapping ensures more nearly constant engagement of the keyseat wiper with the wall of borehole 10 during rotation thereof. Upper and lower or outer pads 90, 190 are similar to reamer outer pads 40, 140 as well as stabilizer outer pads 60, 160 and have similar bevelled truncated outer or upper and lower ends 92, 192 that are flat and horizontally aligned with the ends of the keyseat wiper or wiping tool. Pads 90, 190 have similar arcuate outer surfaces or exteriors 93, 193 respectively, similar to the exteriors 40, 140 of the outer or upper and lower pads of stabilizer 22. As shown, these pads exteriors may have inserts, identical or similar to inserts 87, mounted therein. Each outer surface or exterior 83 of the medial pads or pad-like areas have formed therein a plurality of recesses 84 for receiving replaceable wear-resistant inserts 87 that are similar to inserts 57 of the reamer and have similar cylindrical bodies 88. Recesses 84 and inserts 87 are, preferably, larger and may be of the more aggressive cutting type and wide spacing.

Preferably, the exterior or outer ends of inserts 87 protrude from the pads so as to comprise a substantially continuous borehole wall engagement of the keyseat wiper during rotation of the drill string while providing the requisite area for drilling fluid or mud flow through the intersecting channels. Also, fewer and widely spaced inserts 87 are utilized on pads 80, similar to inserts 57 of pads 50, 60, 160 of the stabilizer, than inserts 37 on pads 30, whereby the periphery of wiper or wiping tool 23 does not appear to be circumferentially surrounded from the axial view point of FIG. 3. In this configuration, however, axial movement as well as rotation of the keyseat wiper effectively engages all of the wall of the borehole 10.

In operation, the borehole wall engaging tools are constructed in accordance with the principles of the invention as exemplified in the stabilizer 22 of FIG. 4, the reamer 21 of FIG. 5, and the keyseat wiper 23 of FIG. 2. Being constructed in accordance with the invention, each tool maximizes the surficial area of borehole wall engagement while minimizing mud flow resistance. Deterioration of the outer surface of each tool due to abrasive wear from borehole 10 is minimized by providing replaceable inserts of tungsten carbide, diamonds or the like. Pairs of intersecting helical grooves or channels of generally rectangular cross section are provided and enhance the area of the diamond-shaped pads from one end of each tool to the other. This design also minimizes obstruction to drilling fluids or mud flow upwardly through the annular passageway between drill string 13 and the walls of the borehole. The inserts projecting from the raised pads or pad-like areas provide a constant three hundred and sixty degree (360°) contiguous contact with borehole wall during both axial and rotational movement of the drill string to increase the stability of downhole operations. An increase in concentricity decreases random oscillation of the drill string and other motion which contribute to power loss and/or damage to said drill string.

It is believed that the operation and construction of the invention will be apparent from the foregoing description. While the apparatus shown and described has been characterized as being preferred, it is obvious that various changes and modifications may be made therein without departing from the spirit and scope of the invention as defined in the following claims.

I claim:

1. A borehole wall engaging tool having a tubular body adapted to be coupled in a rotary drill string and provided with a cylindrical exterior, comprising coextensive longitudinal flow passages in the cylindrical exterior of the body for conducting drilling fluid upwardly past said body exterior, the flow passages being formed by pairs of left and right hand intersecting helical channels extending longitudinally of said body exterior, each longitudinal helical channel having its upper and lower end portions intersecting the upper and lower end portions of adjacent longitudinal channels of another pair whereby each channel coacts with its adjacent channels to provide longitudinally and transversely spaced polygonal wear surfaces therebetween on said body exterior, each pair of channels extending at an acute angle relative to each other and being of less transverse width than the spaced polygonal wear surfaces whereby said polygonal surfaces are of greater area than said channels, said spaced polygonal wear surfaces being disposed in spaced circumferential rows encircling said body exterior, each spaced circumferential row having its wear surfaces disposed in staggered relation to the wear surfaces of its adjacent rows and thereby permit said longitudinally and transversely spaced relationship of said polygonal wear surfaces;

said spaced polygonal wear surfaces of at least one of the spaced circumferential rows are diamond-shaped and have longitudinally and transversely extending corner portions.

2. A borehole wall engaging tool as defined in claim 1 wherein said diamond-shaped wear surfaces are elongated longitudinally so as to be of greater length than width.

3. A borehole wall engaging tool as defined in claim 1 wherein said longitudinal flow passages consist of two (2) pairs of the aforesaid intersecting helical channels.

4. A borehole wall engaging tool as defined in claim 1 wherein the circumferential row of diamond-shaped wear surfaces encircles an intermediate portion of said exterior of said body, said polygonal wear surfaces of the circumferential rows adjacent the intermediate row of diamond-shaped wear surfaces having longitudinal inwardly extending angular portions in overlapping spaced relationship to the longitudinaly extending corner portions of said diamond-shaped wear surfaces of said intermediate row.

5. A borehole wall engaging tool as defined in claim 1 wherein one of the circumferential rows of polygonal wear surfaces encircles each end portion of said exterior of said body, at least one row of said diamond-shaped wear surfaces encircles the medial portion of said body exterior, said polygonal wear surfaces of each row at each end of said body exterior having inwardly extending longitudinal angular corner portions overlapping the longitudinally extending angular corner portions of said diamond-shaped wear surfaces of said medial row.

6. A borehole engaging tool as defined in claim 5 wherein said polygonal wear surfaces of said circumferential rows at the ends of said exterior of said body have truncated outwardly extending longitudinal portions terminating flush with said ends of said body exterior whereby said truncated wear surfaces are pentagonal.

7. A borehole wall engaging tool as defined in claim 1 wherein the longitudinally and transversely extending corner portions of said diamond-shaped wear surfaces overlap the corresponding portions of the wear surfaces of adjacent rows.

8. A borehole wall engaging tool as defined in claim 1 comprising wear resistant means on the staggered wear surfaces of the exterior of the tubular body, the wear resistant means being disposed in staggered arrays on said staggered wear surfaces so as to provide substantially continuous engagement with said borehole wall during rotation of said tool.

9. A borehole wall having a tubular body adapted to be coupled in a rotary drill string and provided with a cylindrical exterior, comprising coextensive longitudinal flow passages in the cylindrical exterior of the body for conducting drilling fluid upwardly past said body exterior, the flow passages being formed by pairs of left and right hand intersecting helical channels extending longitudinally of said body exterior, each longitudinal helical channel having its upper and lower end portions intersecting the upper and lower end portions of adjacent longitudinal channels of another pair whereby each channel coacts with its adjacent channels to provide longitudinally and transversely spaced polygonal wear surfaces therebetween on said body exterior, each pair of channels extending at an acute angle relative to each other and being of less transverse width than the spaced polygonal wear surfaces whereby said surfaces are of greater area than said channels, said spaced polygonal wear surfaces being disposed in spaced circumferential rows encircling said body exterior, each circumferential row having its wear surfaces disposed in staggered relation to the wear surfaces of its adjacent rows and thereby permit said longitudinally and transversely spaced relationship of said polygonal wear surfaces, said spaced polygonal wear surfaces of said body exterior being elongated longitudinally.

10. A borehole wall engaging tool as defined in claim 9 wherein said longitudinal flow passages consist of two (2) pairs of the aforesaid intersecting helical channels.

11. A borehole wall engaging tool as defined in claim 9 wherein one of the circumferential rows of polygonal wear surfaces encircles each end portion of said exterior of said body, at least one row of polygonal wear surfaces encircles the medial portion of said body exterior, said polygonal wear surfaces of each row at each end of said body exterior having inwardly extending longitudinal angular corner portions overlapping the longitudinally extending angular corner portions of said wear surfaces of said medial row.

12. A borehole engaging tool as defined in claim 11 wherein said polygonal wear surfaces of said circumferential rows at the ends of said exterior of said body have truncated outwardly extending longitudinal portions terminating flush with said ends of said body exterior whereby said truncated wear surfaces are pentagonal.

13. A borehole wall engaging tool as defilned in claim 9 wherein said spaced polygonal wear surfaces of each spaced circumferential row on said body exterior having longitudinally and transversely extending corner angular portions overlapping the corresponding portions of the staggered wear surfaces of adjacent rows.

14. A borehole wall engaging tool of the type having a tubular body adapted to be mounted in a drill string adjacent as well as spaced from its drill bit and provided with a generally cylindrical exterior for engagement with said borehole wall, the improvement which comprises a multiplicity of raised pad-like wear areas on the exterior of the body, the raised pad-like wear areas being formed by pairs of left and right hand intersecting helical flow channels in said body exterior and extending longitudinally thereof and coextensive therewith, each pair of right and left hand helical flow channels intersecting only at their medial portions and having their end portions intersecting the corresponding end portions of adjacent channels of another pair whereby said wear areas are longitudinally and transversely spaced from one another, said wear areas being disposed in spaced peripheral rows circumscribing said body exterior, each peripheral row having its wear areas disposed in staggered relation to the wear areas of its adjacent rows to permit the said longitudinally and transversely spaced relationship of said wear areas.

15. A borehole wall engaging tool as defined in claim 14 wherein the spaced wear areas of at least one of the spaced circumferential rows are diamond-shaped and have longitudinally and transversely extending angular corner portions.

16. A borehole wall engaging tool as defined in claim 14 wherein two pairs of left and right hand intersecting helical flow channels coact to provide longitudinal passages for conducting drilling fluid upwardly past said body exterior.

* * * * *